US005168589A

United States Patent [19]

Stroh et al.

[11] Patent Number: 5,168,589

[45] Date of Patent: Dec. 8, 1992

[54] PRESSURE REDUCTION AIR MATTRESS AND OVERLAY

[75] Inventors: Glenn C. Stroh, Marion; Randall L. Ohman, San Antonio, both of Tex.

[73] Assignee: Kinetic Concepts, Inc., San Antonio, Tex.

[21] Appl. No.: 714,379

[22] Filed: Jun. 11, 1991

Related U.S. Application Data

[63] Continuation-in-part of Ser. No. 338,943, Apr. 17, 1989, Pat. No. 5,022,110.

[51] Int. Cl.[5] ..... A47C 27/10; A61G 7/04

[52] U.S. Cl. ..... 5/455; 5/453; 5/457; 5/458; 5/900.5

[58] Field of Search ..... 5/453, 455–458

[56] References Cited

U.S. PATENT DOCUMENTS

| | | | |
|---|---|---|---|
| 2,549,597 | 4/1951 | Harris et al. | 5/457 |
| 2,703,416 | 3/1955 | Owen | 5/457 |
| 3,303,518 | 2/1967 | Ingram | 5/456 |
| 3,740,777 | 6/1973 | Dee | 5/453 |
| 4,054,960 | 10/1972 | Pettit et al. | 5/455 X |
| 4,483,030 | 11/1984 | Flick et al. | 5/455 X |
| 4,662,012 | 5/1987 | Torbet | 5/455 X |
| 4,914,771 | 4/1990 | Afeyan | 5/455 X |
| 5,022,110 | 6/1991 | Stroh | 5/455 |
| 5,090,077 | 2/1992 | Caden et al. | 5/455 X |

FOREIGN PATENT DOCUMENTS

| | | | |
|---|---|---|---|
| 1202100 | 1/1960 | France | 5/455 |

*Primary Examiner*—Michael F. Trettel

[57] ABSTRACT

An inflatable mattress made of multiple, integrally joined cushions designed to reduce patient interface pressures, which may be used separately or as an overlay on a standard hospital bed. Each cushion and section of the mattress is formed by joining upper and lower sheets, both to form the edges of the cushions and sections and to provide a relatively flat support surface which is laterally bounded by inflatable ridges which help keep the patient from rolling or sliding off either side of the mattress. The upper and lower sheets to form the mattress are made from a water vapor permeable but waterproof material, certain sections of the upper surface of the cushions being formed of air-permeable material which serves to allow air to escape in the area where a patient lies to provide comfort and therapy for the patient. A blower for the mattress provides compressed air at separately adjustable flow rates through three separate conduits and also include a heating element for warming the air to enhance the therapeutic benefits of the mattress.

10 Claims, 6 Drawing Sheets

PRESSURE REDUCTION AIR MATTRESS AND OVERLAY

RELATED APPLICATION

This is a continuation-in-part of co-pending application No. 07/338,943, filed Apr. 17, 1989, which is soon to be issued as U.S. Pat. No. 5,022,110, and which is incorporated herein by reference as though set forth in its entirety.

BACKGROUND OF THE INVENTION

The invention relates generally to patient support systems using inflatable cushions or mattresses to reduce patient interface pressures and, more particularly, to air loss mattresses which may be used on standard hospital beds.

In recent years, low air loss beds have come into extensive use and are commonly used in hospitals to prevent and treat the symptoms of immobility. Low air loss beds have been marketed by several companies like Mediscus Products Limited, Kinetic Concepts, Inc., Air Plus, Inc., and SSI Medical, Inc. Many of the products currently in use cost in excess of $10,000.00. However, the most common method of marketing today is to rent these beds to patients in hospitals which may be reimbursed by insurance, Medicare, or Medicaid. Typical rental fees range roughly from $50.00 to $200.00 or more per day. Few hospitals are willing or able to make the large capital expenditures necessary to maintain sufficient low air loss beds to supply patients.

There have been many other devices which have been utilized to attempt to prevent or treat the symptoms of immobility. A common symptom of immobility is decubitis ulcers, which are commonly referred to as bed sores. A primary cause of bed sores is the inability of a patient to move. When a patient is immobile for extended periods, pressure points can cut off the localized blood flow (such as in the skin adjacent a bony protuberance) when the localized pressure exceeds the capillary pressure. When the blood flow in the capillaries is blocked due to the pressure, the cells in that area begin to die and may result in the sore or wound which is called a bed sore. Mobile persons do not have this problem because they periodically move even when asleep, which minimizes the duration of capillary closure in any given area.

Many types of devices have been used to increase the comfort of an immobile patient. These have taken the form of feathers or other types of stuffing material In more recent years, foam has been used as well as innerspring mattresses. While these devices are useful for individuals who are not immobile, they do not provide adequate care for immobile patients. Many devices have been utilized with limited degrees of success to prevent or treat bed sores. Egg-crate type foam has been commonly used although its therapeutic value is questionable. Similar alternating pressure pads have been used. Both have the advantage of being very inexpensive. Waterbeds have also been used, but a waterbed suffers from the hammocking effect where the patient assumes a similar orientation to that of an individual in a hammock suspended between two points. Other types of devices which have been proposed have been non-fluidized sand beds. While the egg-crate foam has been commonly used, waterbeds and other types of similar devices have not met with much commercial success, nor are they considered to be of much therapeutic value.

In the early 1960's, studies were conducted in England by a Professor John T. Scales on the treatment of burn patients who had received skin grafts. When a burn patient receives a skin graft, shear applied to the graft may result in dislocation of the skin graft or layer of skin which has been grafted onto the burned area. This will often result in failure of the graft. Professor Scales originally proposed completely supporting a patient on a high volume of air similar to the principle of a hovercraft. This type of device became known as the levitation bed and is shown in U.S. Pat. No. 3,354,476 issued to John P. Scales. The levitation bed was further perfected in England as shown in U.S. Pat. Nos. 3,340,550 and 3,340,551 issued to Leslie A. Hopkins. Professor Scales and Mr. Hopkins worked together on these devices in the middle 1960's when Professor Scales was at Mt. Vernon Hospital and Mr. Hopkins was at Hovercraft Development, Ltd. Mr. Hopkins was a hovercraft skirt expert and utilized his expertise in this area to make the first workable high air loss bed which has been reported in medical journals. While the high air loss bed would support a patient on a very high volume of air and prevent any shear or damage to the skin, it proved to be impractical. It required a very high volume of air that had to be heated and humidified and was very costly to operate. While sound in theory, the high air loss bed was commercially doomed. Although tests were performed with the high air loss bed, it was eventually abandoned around 1970. In 1968, Mr. Hopkins invented what is now called the low air loss bed. This device is shown in British Patent No. 932,779. This device was further perfected by Professor Scales as shown in U.S. Pat. No. 3,822,425 which called for the use of water vapor permeable but water proof fabric.

At about the same time that Professor Scales and Mr. Hopkins were working on the high air loss bed and low air loss bed, Mr. Thomas S. Hargest came up with the air fluidized bed, or "Bead bed." An example of this is shown in U.S. Pat. No. 3,428,973. Although a geologist by training, Mr. Hargest began work as a clinical engineer in Galveston, Texas at a burn hospital. There, with the assistance of several physicians, Mr. Hargest adapted general air fluidized bed technology (typically used for sandblasting reservoirs) to make a bed which would support a patient. The air fluidized bed (or "bead bed," as it became known) had the advantage of little or no shear, which was very useful for burn patients.

Although both the low air loss bed and the air fluidized bed grew out of research in burns, it soon became apparent that they were also useful for just treating patients that suffered from immobility. The low air loss bed and the air fluidized bed share the common feature of distributing the support of a patient over a much larger surface area of the patient. Such pressure distribution reduced any pressure points that would otherwise exceed capillary closure pressure and reduce blood flow to the point of damage to the skin. Unfortunately, although both the low air loss bed and the air fluidized bed were invented in the late 1960's, neither enjoyed much commercial success for over ten years.

In the 1970's, several other devices were devised which were of some use in treating and preventing the symptoms of immobility. Those devices included the oscillating bed which was invented by Dr. Frances X. Keane which is shown in U.S. Pat. No. 3,434,165. Another such device was the net bed such as shown in U.S.

Pat. No. 4,357,722. Other devices included the Stryker brand frame and the Circle Electric bed. Various alternating pressure pads such as those marketed by Gaymar also came into use. While each of those devices have some therapeutic value, apparently they have yet to achieve the commercial success of low air loss beds and air fluidized beds in treating and preventing immobility.

There have been many improvements made in the low air loss bed which was invented by Mr. Hopkins and Professor Scales. Much of this work was done at Air Cushion Equipment, Ltd. which was owned and operated by Mr. Leslie A. Hopkins. Mr. Roy Henvest, Mr. Robert Cook, and Mr. Graham Westerling-Norris. Improvements in the low air loss bed were also made by Mr. Frank Ducker and Mr. William B. Hunt at Mediscus Products, Ltd., who made the first commercial low air loss bed in about 1973.

For many years, there have been attempts at making an inexpensive device that would serve the purpose of the low air loss bed. Air fluidized beds which typically weigh as much as one ton could not be considered in the same category as low air loss beds, particularly the portable type. The attempts to make such an inexpensive device began with Mr. Hopkins as early as 1968 and were continued by Mr. Hopkins at Air Cushion Equipment Limited for almost ten years. They were carried on by Mr. Robert Cook at Air Cushion Equipment Limited and then later by Mediscus Products, Ltd., but all such attempts have met only limited success. In lieu of no commercially practical low air loss support mattress, until now the market has resorted largely to other less costly but questionably effective devices such as the alternating pressure pads and egg-crate foam mattresses as a substitute for relieving patient interface pressures.

From the beginning, it was Mr. Hopkins'dream to build a poor man's low air loss bed. This is exemplified in his initial low air loss device shown in his original patent which was little more than a mattress. However, the direction of development did not go that way and beds after Mr. Hopkins'initial bed were generally full-sized beds with complete frames. Mr. Hopkins again proposed a form of portable low air loss bed in about 1976, when he was a consultant to Mediscus Products Limited which is shown in British Patent No. 1,545,806. Design work continued at Air Cushion Equipment, Limited in the middle 1960's on the portable low air loss bed and most of the design was made by Mr. Robert Cook. Air Cushion Equipment, Limited was retained by Mediscus Products, Limited and the work there of Mr. Cook resulted in the first commercial low air loss mattress which was intended to be usable on any type of bed frame. The device which was conceived and initially constructed by Mr. Cook at Air Cushion Equipment, Limited is exemplified in U.S. Pat. No. 4,525,885. Another attempt at a less expensive low air loss bed is shown in British Patent No. 2,134,379B. None of these devices have enjoyed any commercial success, in particular the device shown in U.S. Pat. No. 4,525,885 was commercially abandoned because of hygiene problems.

A more recent attempt at an inexpensive support mattress is shown in U.S. Pat. No. 4,803,744 which is assigned to Hill-Rom Company, which is probably the largest hospital bed manufacturer in the U.S. As of yet, this device has not achieved any significant commercial success nor is it believed that it is likely to.

There are believed to be many thousands of patients who suffer the complications of immobility but who receive no treatment on air fluidized beds or low air loss beds because of the substantial costs involved and the lack of funds. This is particularly acute in nursing homes where the products are badly needed but generally unavailable because of the cost. While many other devices such as the egg-crate foam and other systems have been used, they have not solved the problem, nor will they ever.

It is an object of the present invention to provide a relatively low-cost and simple air mattress which would serve the purpose of a low air loss mattress and could be used on standard hospital beds while being commercially practical as well as therapeutically effective. It is another object of the invention to provide a lightweight, inexpensive mattress which is therapeutically similar to low air loss bed and the air fluidized bed but which does not cost as much to manufacture or maintain.

In his initial patent on the low air loss bed, Professor Scales proposed the use of waterproof but water vapor permeable material. This type of material has gained widespread use with the advent of Gortex brand laminate which has established itself in the medical area as being a highly effective and useful material. While air permeable (or high air loss) Gortex material (i.e., one of the nylon materials laminated with the Goretex brand laminate and manufactured by the W. L. Gore Co.) has been available, the most commonly used version of Gortex in low air loss beds is air-impermeable but water vapor permeable. This Gortex material or laminate is typically attached to a woven nylon material. For comfort and therapeutic reasons, it is often desirable or necessary to provide air flow around the patient. It is generally accepted that skin which remains in contact with liquid or excessive vapor is more subject to skin breakdown. This is readily recognized by anyone who spends a large amount of time in water which causes a wrinkling of the skin. Both the air impermeable and air permeable Gortex materials largely eliminate such problems. There have been other types of water vapor permeable materials which have also been proposed, but they have not obtained the widespread acceptance and use as has Gortex brand material. Since the initial commercialization of the low air loss bed, one of its largest benefits has been considered its ability to control the environment with low air loss around the patient as well as control the pressure through the low loss of air. A patient would not find a typical air mattress to be comfortable for any extended period of time because it is typically made of material which is completely airtight and water vapor impermeable and which does not have careful pressure regulation. Furthermore, a patient would sweat and be less comfortable when in contact with a vinyl material which was generally impermeable. Others have proposed use of air and water impermeable materials with holes punched therein to provide an air exhaust for their low air loss beds.

It is an object of the present invention to combine the benefits of low air loss beds and the use of water vapor permeable materials in a low cost mattress. It is also an object of the invention to provide the benefits of low air loss beds and low air loss therapy in an inexpensive mattress.

While the present invention requires an air supply blower, it is the object of the present invention to be able to utilize a relatively small and inexpensive blower. Air flow around a patient, however, may also cause some cooling of the patient's skin more particularly in the extremities of a patient. Studies have also indicated that slightly elevated temperatures may enhance the healing process in certain applications. Therefore and for other reasons, another object of the invention is to provide thermal controls for comfort and therapy of a patient supported on a mattress.

It is a further object of the invention to provide for adjustable pressure differentials in various sections of the mattress to provide comfort to compensate for weight distributions which vary from patient to patient or from time to time as a given patient's position may change. Typically, for any given patient there is more weight in the buttocks area than on the heels and the head so pressure differentials are desirable in order to properly support the patient lying on the mattress, particularly if the patient's upper body is elevated toward a sitting position.

Still another object of the present invention is to provide a relatively level patient support surface with adaptations to help prevent the patient from rolling or sliding to either side of the patient support surface.

It is another object of the present invention to provide a low cost, inexpensive low air loss support system which combines the therapeutic benefits of use of a water vapor permeable material and airflow around the patient as well as separate sections which have adjustable pressures. The intent is to achieve all of these objects with an affordable mattress that can be used on regular hospital beds or other support surfaces and which is inexpensive to manufacture and use and which may even be disposable.

Many other objects of the invention will be apparent from the following summary and detailed disclosures, particularly when viewed in light of the claims and drawings appended hereto.

BRIEF SUMMARY OF THE INVENTION

The invention includes a low air loss therapeutic patient support system that is made up of connected air cushions which form a low air loss patient support mattress when inflated. The mattress may be used on standard hospital beds or other flat supports. The multiple cushions allow for variable pressure to support a patient and to compensate for different weights of various portions of the body of the patient. Each cushion is provided with air vents in its upper surface to provide air circulation around a patient and for pressure regulation in each cushion. Retainers are provided to vent billowing of each cushion in its center portions and maintain a substantially level patient support surface. A small portable blower provides a constant air supply for each of the cushions and allows adjustment of the air pressure in each of the cushions to accommodate varying weights of patients on the mattress.

Further aspects and objects of the invention will be apparent from the description of the preferred embodiments in the following more detailed descriptions, especially when viewed in conjunction with the drawings and in light of the appended claims.

DETAILED DESCRIPTION OF PREFERRED EMBODIMENTS

Figure 1:
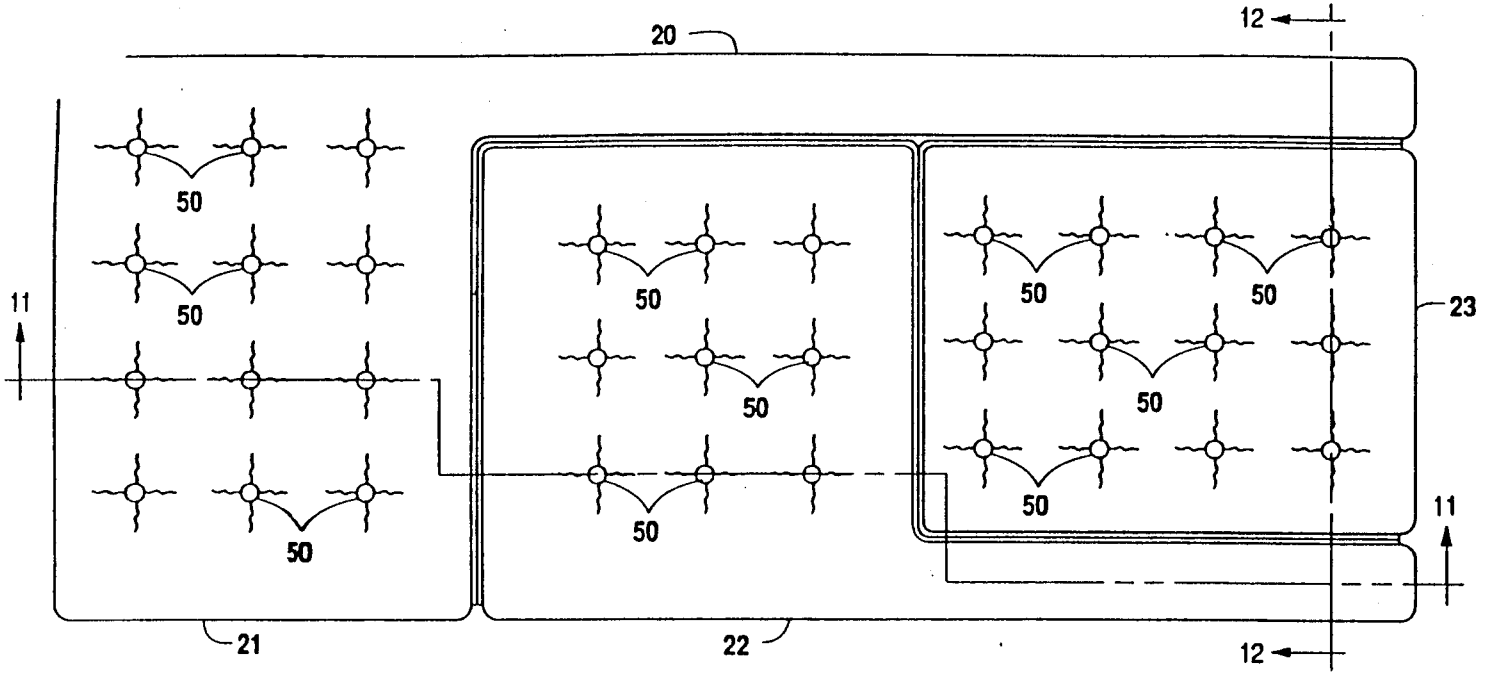
FIG. 1 shows a plan view of the mattress of the first embodiment of the invention.
Figure 2:
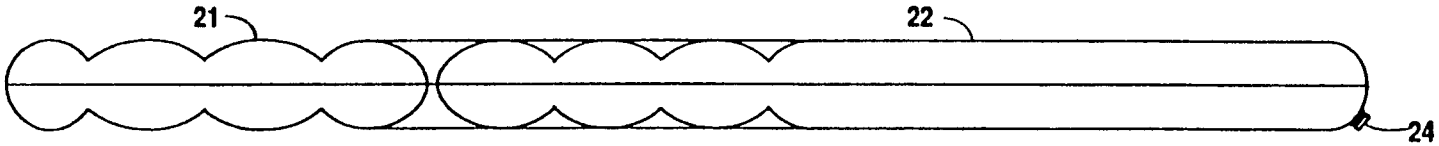
FIG. 2 shows a side elevation view of the mattress shown in FIG. 1.

The mattress of a first embodiment of the invention is generally represented as 20 in FIG. 1. The mattress 20 is made up of three cushions or sections 21, 22, and 23. Section 21 is generally referred to as the head portion, section 22 is generally referred to as the body portion, and section 23 is generally referred to as the foot portion.

Figure 3:
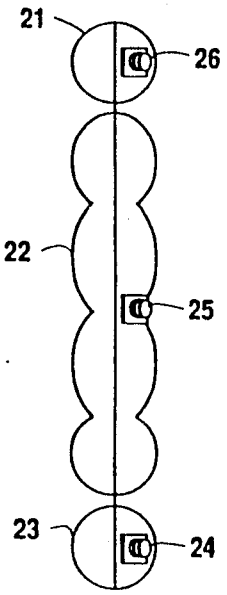
FIG. 3 shows an end elevation view of the mattress shown in FIG. 1.

Each of the cushions for sections 21, 22, and 23 are provided as shown in FIG. 3 with air supply nipples 24, 25, and 26. The nipples 24, 25, and 26 are connected to air supply hoses from a blower unit which may be mounted in the floor or hung on the side of a support bed frame. Typically, the blower unit would be a self-contained unit with three air supply hoses and three air control valves and an optional heater to supply air to each of the mattress sections. Air control valves would be provided in the blower to control the air pressure in each of the sections and thus allow adjustment of the pressure in each of the sections to provide comfort depending upon the size and weight of the patient lying on the mattress. Such air supply blowers are commonly used by numerous manufacturers of low air loss beds and typically include an air supply blower connected to an air filter. The outlet of the air supply blower is connected to a plenum chamber and three valves are connected with the plenum chamber to supply air through air supply lines to the nipples 24, 25, and 26. A heater may also be positioned within the air plenum chamber. A quick release dump valve may be provided with a plenum chamber to dump air from the mattress for cardiac arrest procedures and the like.

The construction of the mattress is important because a very important part of the invention is its low cost and its ease of manufacture. This is made possible by the simplified construction. The mattress is constructed of the components generally shown in FIGS. 4, 5, 6, 7, 8, 9, and 10. The nipples 24, 25, and 26 shown in FIG. 3 also form a part of this construction. The components are sewn together using commercial sewing machines. The needles of each sewing machine forms stitch holes which allow air to vent from the mattress. The first commercially available low air loss beds similarly had air bags which were stitched and used the stitch holes for some air loss. Commercial seam sealers are commonly available to seal the seams and stitch holes as desired by adhering a narrow tape-like material thereto using a blast of hot air. This technique is commonly used for sealing the seams and sealing the seams and stitch holes of water permeable but waterproof articles of clothing.

Figures 4, 5, 6, 7, 8, 9, 10:
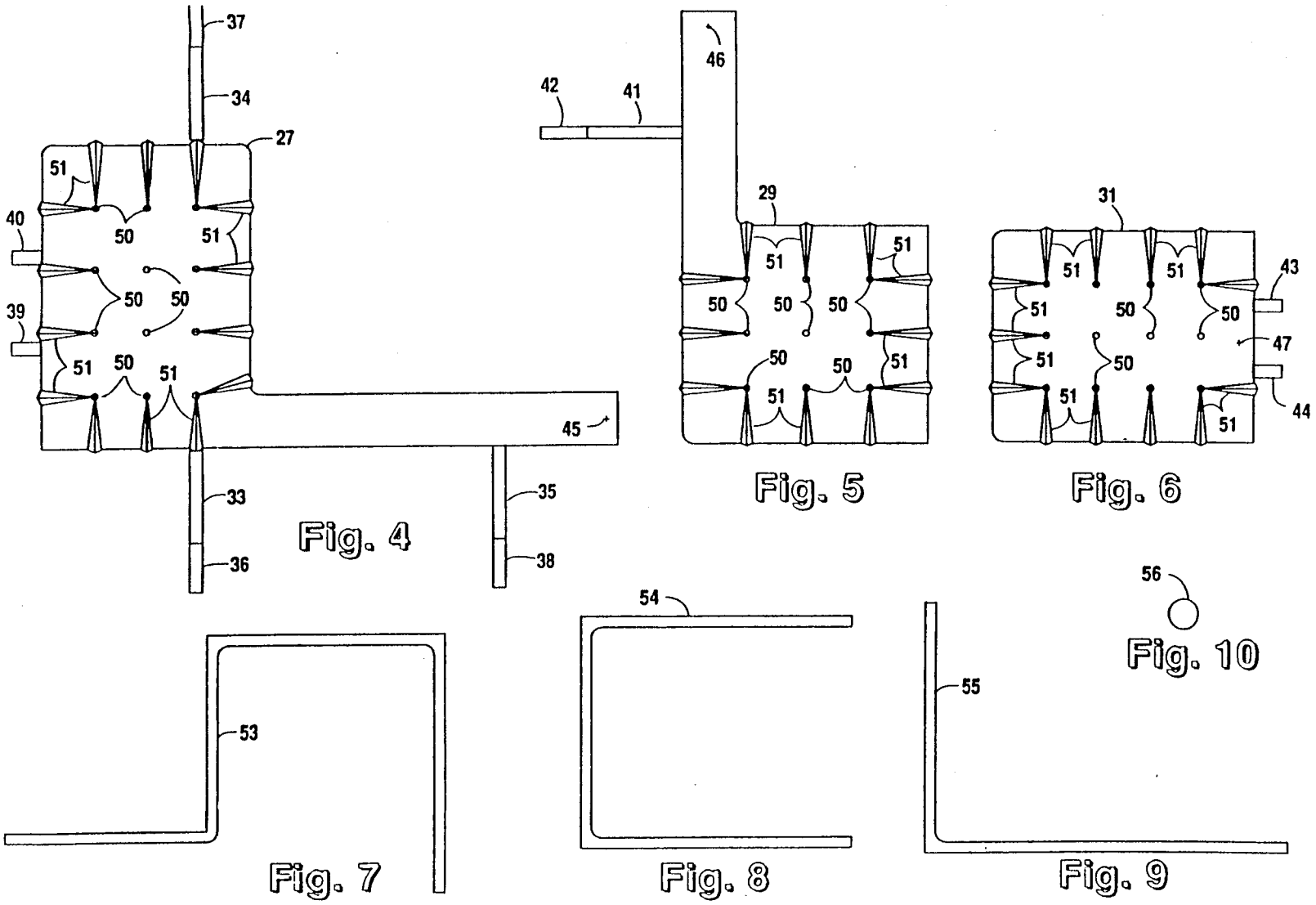
FIG. 4 shows one half of one of the head sections of the mattress shown in FIG. 1.
FIG. 5 shows one half of one of the abdomen sections of the mattress shown in FIG. 1.
FIG. 6 shows one half of one of the foot sections of the cushions of the mattress shown in FIG. 1.
FIG. 7 shows a strip used to connect the cushions of the mattress in FIG. 1.
FIG. 8 shows another strip used to connect the cushions of the mattress in FIG. 1.
FIG. 9 shows another strip used to connect the cushions of the mattress in FIG. 1.
FIG. 10 shows a reinforcing and sealing patch that is used for each of the retainers for the mattress in FIG. 1.
Figure 14:
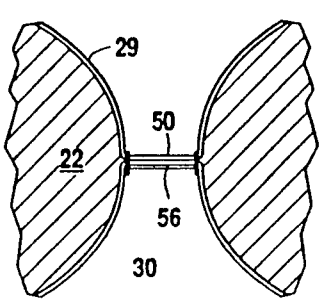
FIG. 14 shows another detail of a portion of FIG. 11 as indicated.

Generally, the mattress comprises upper and lower sections or sheets stitched together to form inflatable enclosures. Cushion 21 includes an upper sheet 27 shown in FIG. 4 and a lower sheet 28 shown in FIG. 13. The upper and lower sheets 27 and 28 are the same, which simplifies construction. Similarly, sheet 22 as shown in FIG. 1 is formed of an upper sheet 29 as shown in FIG. 5 and lower sheet 30 as shown in FIG. 14. Cushion 23 is similarly formed from an upper sheet 31 shown in FIG. 6 and a lower sheet 32 shown in FIG. 15.

The section 21 includes retaining straps 33, 34, and 35 as shown in FIG. 4. Portions of hook and loop fasteners 36, 37, and 38 are secured on the retaining straps 33, 34, and 35 respectively. Additional hook and loop connectors 39 and 40 are also provided. As shown in FIG. 5, another retaining strap 41 is provided with hook and loop fastener 42 at one end. As shown in FIG. 6, hook and loop fasteners 43 and 44 are provided. The hook and loop fasteners secure the mattress to a support bed frame, regular mattress, or the like.

Figure 15:
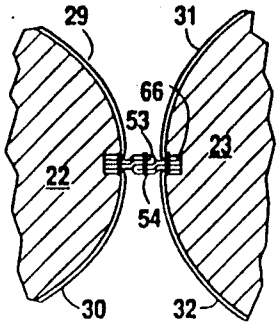
FIG. 15 shows another detail of a portion of FIG. 11 as indicated.

The nipple 24 as shown in FIG. 3 is positioned at point 45 as shown in FIG. 4 but on lower sheet 28. The nipple 25 shown in FIG. 3 is positioned at point 46 as shown in FIG. 5 but on lower sheet 30 as shown in FIG. 15. The nipple 26 shown in FIG. 3 is positioned at point 47 as shown in FIG. 6 but on sheet 32 as shown in FIG. 15.

Retainer dimples 50 are provided as shown in FIGS. 4, 5, 6, and in detail in FIG. 14. Each retainer dimple is identical so only one is shown and described in detail. The billowing of the mattress and also act as air vent holes to help regulate pressure in each section and to provide airflow for patient comfort. Conventional darts are provided to provide a flat and relatively smooth surface when the mattress is inflated as generally shown in FIGS. 1, 2, 3, and 11 through 16. The darts 51 are much like those used in typical clothing manufacture and sewing. The darts help prevent bunching of the material and enhance the appearance and aid in construction and manufacture. Baffle strips could also be used to connect the upper and lower sheets of each cushion. Conventional low air loss bags use horizontal baffles to prevent billowing of air bags with the stitch holes from sewing providing air vents under the patient.

Figure 11:
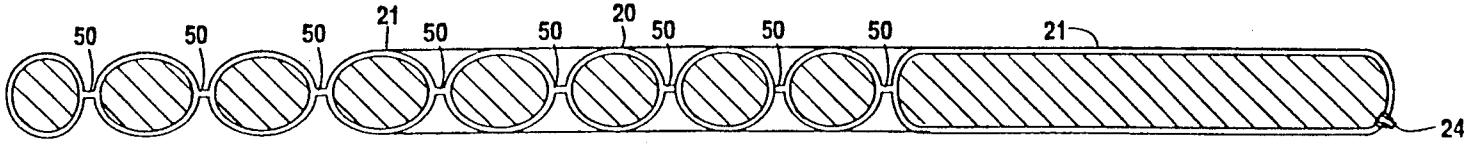
FIG. 11 shows a cross section as indicated in FIG. 1.
Figure 12:
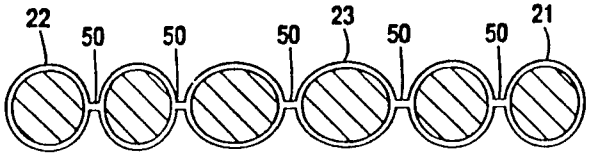
FIG. 12 shows another cross section as indicated in FIG. 1.
Figure 13:
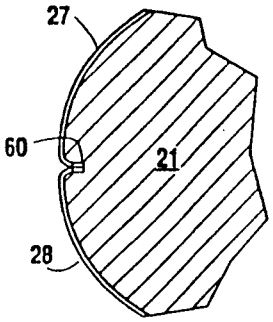
FIG. 13 shows a detail of a portion of FIG. 11 as indicated.

As shown in FIGS. 4, 5, and 6 connector strips 53, 54, and 55 are provided to connect the six upper and lower panels of sheets shown in FIGS. 4, 5, 6, 13, 14, and 15. These consist of flat strips of material which are used to connect the free sections which are formed of the upper and lower sheets. A flat piece of sealing patch material 56 as shown in FIG. 10 is provided to help form the vents or retainers 50. The detailed construction of the mattress is best shown in FIGS. 11–16 which show details of the completed mattress that is made from the components shown generally in FIGS. 4–10. FIG. 13 shows a detail of mattress section 21 as shown in FIG. 11. In particular, at the edge of each of the mattress sections 21, 22, and 23, the upper and lower sections are connected together by common means such as sewing. This is shown in FIG. 13 which shows the upper and lower sections 27 and 28 sewn together at 60. The retainer dimple 50 shown in FIG. 4 is shown detail as indicated in FIG. 14. In particular, the patch 56 as shown as FIG. 10 forms the bottom of each retainer 50 and acts as a seal and reinforcement for any stitch holes which were formed in sewing the material. The patch 56 is heat sealed onto each lower sheet at each dimple to seal the stitch holes. Since the material typically comprise of water vapor permeable but waterproof material that is laminated to a woven nylon material, sewing results in needle holes which allow air to exit. The preferred material is sold under the trademark Goretex by W.L. Gore & Company. In order to limit air from exiting from the cushions 21, 22, and 23, the sealing member or patch 56 is utilized. As is apparent in FIGS. 1, 4, 5, and 6 each retainer 50 is formed generally round by sewing a circle that joins together the upper and lower sheets as 27 and 28, 29, 30, and 31, and 32. The connection detail is shown in FIGS. 13, 14, and 15. Since the circle of stitch holes in the upper portion of retainer 50 are not sealed, air exits from these vent holes and since the patient is lying above these vent holes, air will flow over the patient and provide drying and temperature control.

Strips 53, 54 and 55 as shown in FIGS. 7, 8 and 9 connect the upper and lower halves of sections 21, 22 and 23 together as best shown in detail in FIG. 15. In particular, FIG. 15 shows the detail of the connection between sections 22 and 23. In particular, flat members 53 and 54 are used to connect sections 22 and 23. Member 53 would be sewn between the connection of sheets 29 and 30 of section 22 and member 54 of FIG. 8 would be sewn between the connection 66 of sheets 31 and 32 of section 23 as shown in detail in FIG. 54 are connected at 65 and 66 with the members 29 and 30 and 31 and 32 respectively to limit air leakage. Although connectors 53, 54, and 55 are sewn together, other connecting means might be used. Examples would be zippers and hook and loop fasteners. When made releasable from each other, the sections 21, 22, 23 might be replaced individually to permit replacement of damaged or stained sections. While it is possible to wash and disinfect a mattress, it would not likely be reused if stained with body fluids.

Figure 16:
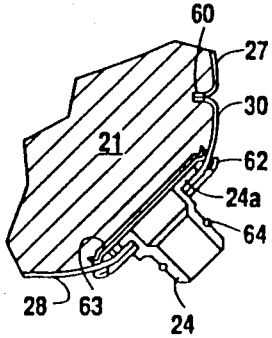
FIG. 16 shows another detail of a portion of FIG. 11 as indicated.

The details of each nipple connection is shown in FIG. 16 which shows nipple 24 connected between reinforcing strips 62 and 63 which are sewn around an opening or hole 45, as located in sheet 28 as indicated in FIG. 4. It is understood that the nipple 24 includes a flange 24A which is trapped between the strips 62 and 63 to retain it in position. An O-ring 64 may be provided on the nipple to seal with a connector as desired.

As is apparent from the above detailed disclosure, the limited number of components of the mattress provides for economy of construction and ease of manufacture. A minimum number of components is provided which are connected by conventional sewing techniques with preferably all of the needle holes and seams sealed except for the upper sheets of the cushion at the dimples to reduce air low. Reducing air loss by the sealing of most of the stitch holes and seams provides less air escape which reduces the size of the blower required to maintain the mattress inflated. While on regular low air loss beds, it may not be necessary to seal the seams and stitch holes formed by stitching the fabric together that forms the multiple air sacs, it is more significant in the instant invention because it helps reduce the cost of manufacture and operation of the blower less expensive.

In use, the low air loss mattress 20 shown in FIG. 1 could be placed on a standard hospital bed mattress. Alternatively, the standard mattress could be removed and the low air loss mattress 20 used in lieu of the standard mattress. The straps and connectors 33–38 and 41–42 shown in FIGS. 4–6 help secure the mattress to the frame or hospital mattress. When connected with a standard blower unit the mattress would be inflated as shown in FIGS. 2, 3, 11–12. Because the retainers 50 prevent billowing, the upper surface of the mattress would be generally flat as shown in FIGS. 2, 3, 11 and 12. Since patches 56 seal lower stitch holes for retainers 50, air would generally only be allowed to flow upwardly in the area of the patient. Similarly, connections 60 shown for the section 21 and FIG. 13 and like connections at the outer edges of sections 22 and 23 could be sealed. The stitched connections 65 and 66 of members 53 and 54 as shown in FIG. 15 could similarly be sealed as could the nipple 24 as shown in detail in FIG. 16. Accordingly, most of the air loss could be limited to the upper surface area of the retainers 50 which act as air vents in the area where a patient lies as shown in FIG. 1. The air vent holes would provide cooling of the patient to provide comfort and which in the case of wounds to assist in healing of the wounds. It would also allow for venting of the mattress to allow pressure control in each of the sections or cushions 21, 22 and 23 so that they could be adjusted to accommodate patients of varying heights and weights. It is understood that with low air loss beds it is desirable to adjust the pressure in each section or group such that the patient would sink down into the mattress without bottoming on the support surface. In this way, pressure against the patient's skin would be distributed over a larger surface area and the patient would be less likely to suffer skin breakdown or bed sores.

While a blower is not shown in FIGS. 1–16, a blower may be employed with mattress 20 having the same or similar components as those disclosed in U.S. Pat. No. 5,003,654, issued Apr. 2, 1991, which is incorporated herein for all purposes by this specific reference thereto As an alternative, a blower may be substituted in the form of blower 200 described below in conjunction with the second embodiment of the invention.

Figure 17:
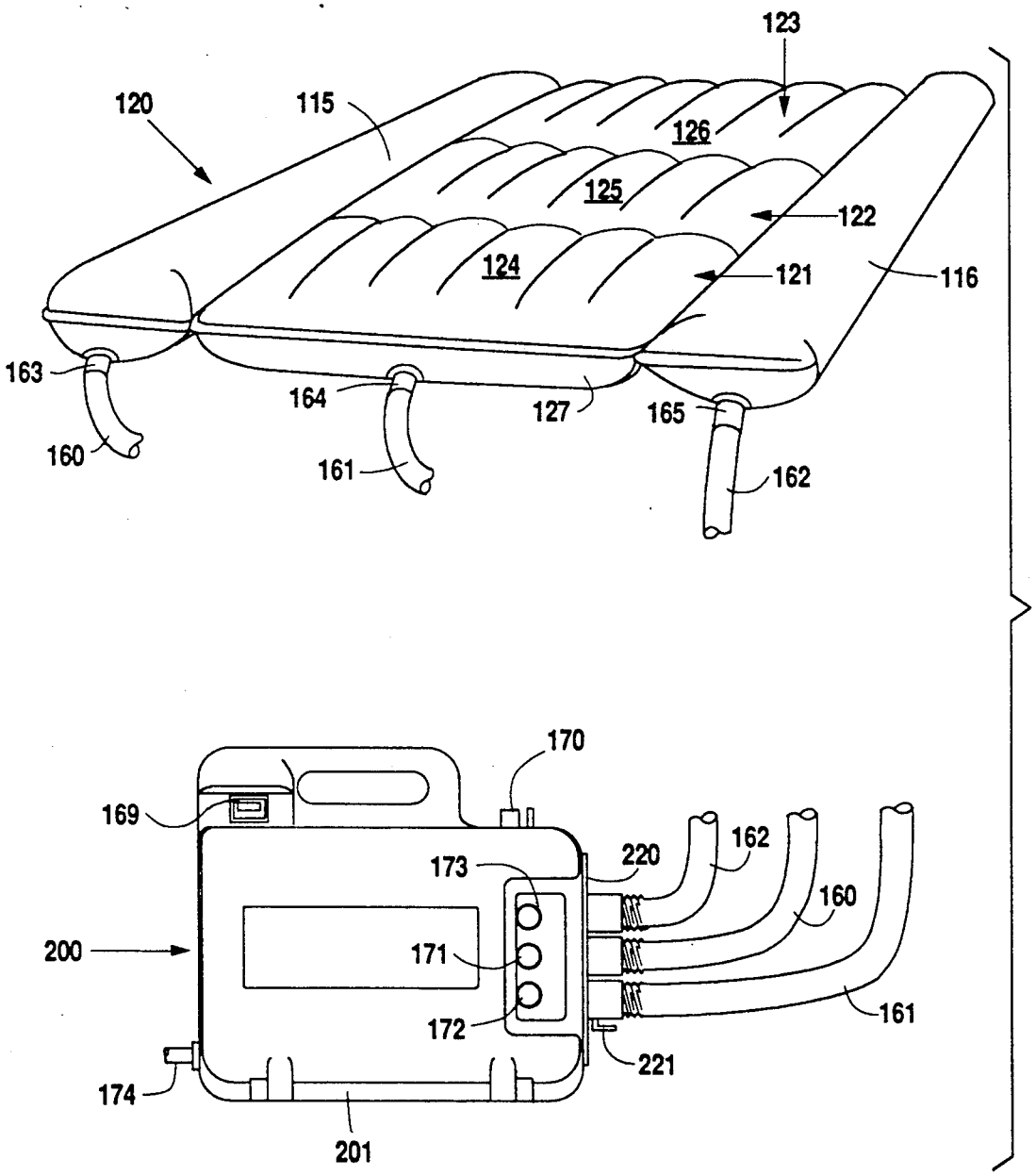
FIG. 17 shows a perspective view of the mattress and blower of a second embodiment of the present invention.

Referring to FIGS. 17–21, a second embodiment is shown which includes several features of the first embodiment while also including other inventive aspects of the present invention. The second embodiment as a whole, commercially available under the trademark "First Step Plus" , is manufactured and marketed by Kinetic Concepts, Inc. (KCI) of San Antonio, TX, which may be consulted for complete product and safety information. As shown in FIG. 17, the second embodiment generally includes a mattress 120 (also referred to as a "mattress overlay"), a blower unit 200, and flexible air hoses 160–162 therebetween. As with the first embodiment, the second embodiment is only one preferred embodiment of the invention and includes many features which could be eliminated, substituted by equivalents, varied, replaced, improved, combined or subdivided while still capturing the essence of the invention, which is best expressed and should only be limited by the claims appended to this description.

Mattress 120 is preferably employed as an overlay atop a standard hospital mattress (not shown), although many of its benefits can be appreciated with it employed atop any support surface. Referring to FIG. 17, mattress 120 is an integral mattress comprising three cushions 121, 122 and 123 and two lateral side cushions 115 and 116 (also referred to as "air rails"115 and 116). Each of the cushions 115, 116 and 121–123 are inflatable, fabric enclosures formed of Gortex material, as in the first embodiment (except as may be otherwixe described further herein). Each of cushions 121–123 is seperately inflatable (i.e., inflation of each of cushions 121–123 is not dependant on inflation of the others of cushions 121–123), although inflation of cushions 122 and 123 is dependant on inflation of air rails 115 and 116.

The relative size, shape and position of cusions 121–123 and air rails 115 and 116 is such that a normal-sized adult patient can lie back-down, lengthwise on cushions 121–123, with his/her shoulders each fitting between air rails 115–116. Cushions 121–123 preferably correspond to the foot, body and head portions, respectively, of a supported patient (not shown). Accordingly, section 121 is generally referred to as the foot portion, section 122 is generally referred to as the body portion, and section 123 is generally referred to as the head portion.

Figure 18:
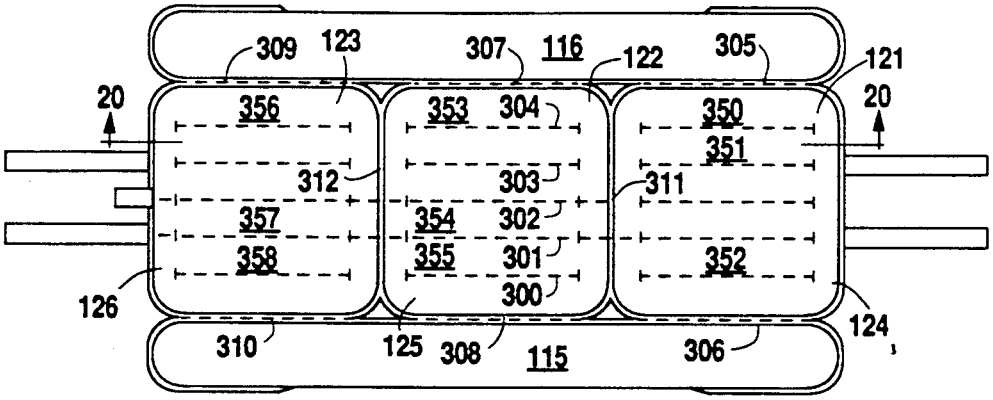
FIG. 18 shows a top plan view of the mattress shown in FIG. 17.
Figure 19:
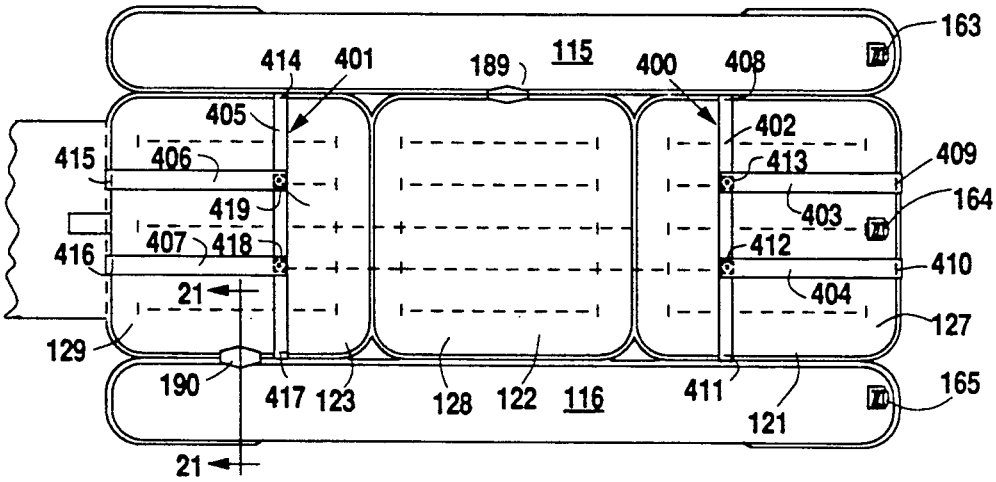
FIG. 19 shows a bottom plan view of the mattress shown in FIG. 17.

Preferably, cushions 121–123 are generally square in shape in the plan view (FIG. 18). To help prevent billowing and provide a relatively level patient support surface, each of cushions 121–123 is provided with five parallel baffles which join the upper and lower sheets thereof. For example, cushion 122 has five baffles 300–304 therein, each of which length of the mattress 120. As shown best in FIG. 21, each such baffle—baffle 304 being shown—is stitched along its upper and lower edges to the upper and lower sheets 125 and 128, respectively, of cushion 122. Thus, baffle 304 (and all other baffles of the embodiment) serve as a retainer for keeping the upper and lower sheets within a limited distance of separation.

Air rails 115 and 116 are elongate sections located along the opposite lateral edges of mattress 120. Each of air rails 115 and 116 are integrally joined by stitching to each of cushions 121–123 along the lateral edges thereof. As is evident in FIG. 17, air rails 115 and 116 have a greater height, or profile, than cushions 121–123, when inflated This greater profile is provided to help prevent a patient from rolling or sliding off the upper surfaces 124–126 of cushions 121–123 and to maximize comfort and the feeling of security for patients supported on mattress 120.

With air rails 115 and 116, which are inflated when each of cushions 122 and 123 (respectively) are also inflated, the patient is more easily centered on the overlay, and is cradled on each side of the patient by air-filled sections that extend approximately one to two inches above the upper surfaces 124–126 of cushions 121–123.

Air rails 115 and 116 are fluidly connected to cushions 122 and 123 by means of fluid openings through tubes 189 and 190, respectively. Tube 189 is substantially the same as tube 190. Referring again to FIG. 21, tube 189 actually includes two sub-tubes 191 and 192 which are stitched together to provide a relatively sealed fluid connection between air rail 115 and cushion 122. The inflation of air rails 115 and 116 therefore correspond with inflation of body section 122 and head section 123, respectively. Generally speaking, body section 122 is adjusted to be inflated at the highest pressure whereas head section 123 is adjusted to be inflated at a slightly lower pressure and foot section 121 is generally adjusted to be at the lowest pressure of the three cushions 121–123. When the head section is articulated for sitting the patient up, naturally, the pressure in seat section 122 must also be compensated to a higher level. With body section 122 and head section 123 always inflated to a higher level than foot section 121, air rails 115 and 116 are ensured in practice of being filled with relatively high pressure air at all times despite some differential between the pressure and air-rails 115 and 116.

There are three air inlets for mattress 120, provided by nipples 163–165, which are of the same construction and are connected to mattress 120 in the same manner as nipples 24–26 in the first embodiment. Nipples 163–165 may be connected by friction-fit (possibly in conjunction with an adhesive for more permanent connections) to air supply hoses 160–162. Air supply hoses 160–162, in turn, are connected to blower unit coupling 220 in a similar manner.

During preferred operation of the second embodiment, the blower unit is first turned on to inflate mattress 120, and a patient is centrally positioned lengthwise on mattress 120. The height and articulation of the mattress 120 can. be adjusted according to the capacity of the frame upon which the mattress is placed. Once the patient is centrally positioned on the mattress 120, pressures in each overlay can distribute the weight and reduce interface pressures for an individual patient.

Referring to FIG. 17, blower unit 200 is adapted with adjustable hooks (not shown) for hanging blower unit 200 on the footboard or side rail of a support bed frame. During use of mattress 120, blower 200 may also be placed on the floor of a room if a footboard or the like is not available. The blower unit 200 is a self-contained unit with three air control valves which are manually adjusted by knobs 171–173, for supplying air at adjustable pressures to each of the mattress sections 121–123, respectively.

Blower unit 200 also includes a heater for raising the air temperatures entering the mattress 120 through hoses 160–162, as an aid in the increase of patient comfort and as an aid to therapy. The degree of heating is adjusted by means of heater control knob 170. Power is provided for operation of blower 200 by means of a conventional power cord 174, adapted to be plugged into available power outlets in hospital settings. Battery power is another alternative.

Air supply hoses 160–162 are actually connected to a quick-release hose coupling 220 which in turn is releasably mounted to blower unit 200 in a manner which allows sealed flow of air from the blower unit through each of lines 160–162. Quick release coupling 220 is adapted to be quickly released from the housing 201 of blower unit 200 in order to dump air from mattress 120 while simultaneously shutting off the air supply thereto. That feature can be quite advantageous for cardiac arrest procedures and the like. Quick disconnect coupling 220, more particularly, includes a spring-biased lever 221 which releases coupling 220 from housing 201. Hoses 160–162 are connected by means of a friction fit nipple or by other more permanent means. O-rings or other flexible bushings are inserted between coupling 220 and housing 201 to enable a fluidly sealed connection therebetween.

To provide localized airflow (and corresponding heating when a heater is employed), certain panels of the upper surfaces 125–127 of cushions 121–123 are preferably more permeable than other panels. Preferably, the panels of higher permeability are air permeable and the panels of lower permeability are air impermeable during normal use, although all panels are vapor-permeable and waterproof. The panels of higher permeability are also referred to as "high air loss" material while the panels of lower permeability are also referred to as "low air loss" material. In the second embodiment, referring to FIG. 18, panels 350, 352, 353, 355, 356 and 358 are all of lower permeability than panels 351, 354 and 357, which are of higher permeability. To achieve this, 351, 354 and 357 are all formed of Goretex material marketed as the "First Generation" Goretex, and the other panels (as well as all other Goretex sheets of mattress 120) are all "Second Generation" Goretex. The high air loss panel 351 is of larger size (three times as wide, as is shown in FIG. 18) in the preferred embodiment to allow greater airflow around the feet of a patient than around the other sections Each of the panels are sewn and seam-sealed with each other to form the upper surfaces of the cushions 121–123.

Referring to FIGS. 18–21, the construction of mattress 120 can be readily appreciated, especially when considered in embodiments herein. Each of cushions 121–123 is substantially the same, except that foot section 121 has a nipple 164 in its lower panel 127 and does not have provision for a fluid connection with one of air rails 115 and 116. To make mattress 120 in the preferred manner, each of the cushions 115, 116 and 121–123 are seperately formed by stitching the appropriately-shaped piece of Goretex material along seams to obtain the cushion shapes substantially as shown in the drawings. Each air-rail 115–116 may be formed of a unitary piece of Goretex (not considering the piping) material stitched along the entire length of a seam.

Figure 20:
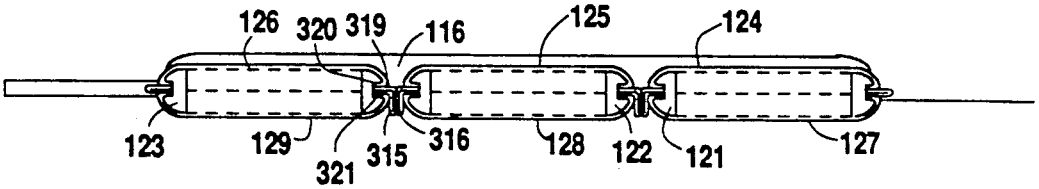
FIG. 20 shows a cross-sectional view of the mattress shown in FIG. 18.
Figure 21:
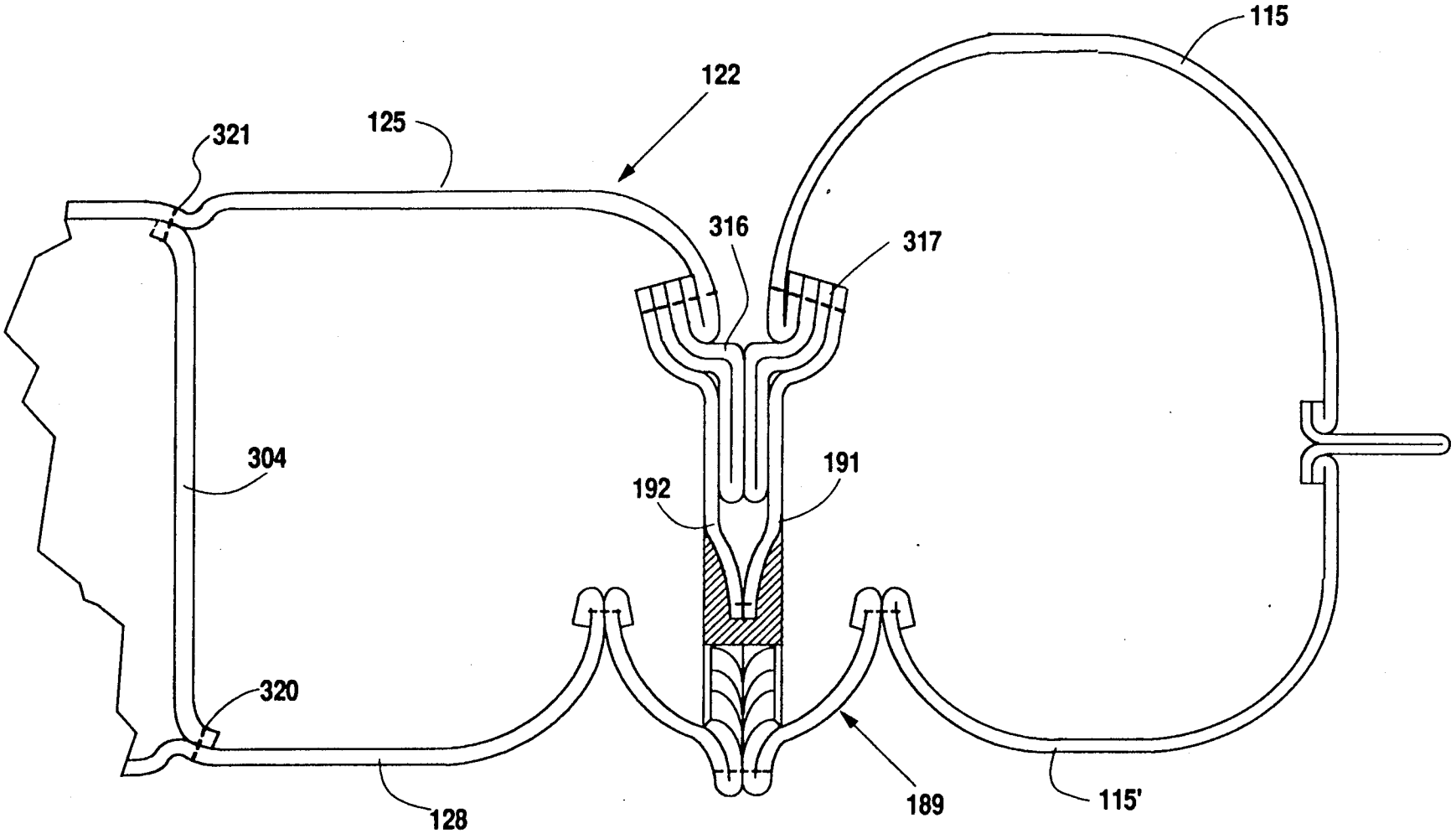
FIG. 21 shows a cross-sectional view of the blower unit shown in FIG. 19.

Preferably, referring to FIG. 20, the edges of the Goretex fabric pieces are stitched together with piping therebetween. For instance, cushion 126 is formed (in part) by turning the edge 320 of its upper sheet 126 and the edge 321 of its lower sheet 129 inward, positioning piping 315 between edges 320 and 321, and then stitching the edges 320 and 321 and the piping 315 together from the inside using conventional sewing techniques to form an internal (or "hidden") seam 319 with piping fringe 315 protruding outwardly along the edges of the cushions 122. As with each seam of mattress 120 whenever feasible (including with baffle seams such as seam 321 which joins baffle 304 to the upper sheet 125), the seam 319 is then seam-sealed after stitching A space is left in the stitching of cushions 122 and 123 to allow for later insertion of tubes 189 and 190 before stitching those tubes in place Once seperately formed, the protruding piping fringes 315, 316 of each cushion 115, 116, 121–123 are then stitched together along each of their mating edges to form seams 305–312, thereby providing the general form of mattress 120. Then, sub-tubes 191 and 192 of the appropriate tubes 189 and 190 are inserted between the piping 315, 317 and the edges of the lower sheets or portions 128, 115'of cushion 122 and air rail 115, respectively, and they are then stitched and sealed in place to provide the fluid connections between air rails 115 and 116 and cushions 122 and 123 (respectively). Preferably all stitched seams are seam-sealed as described in connection with the first embodiment, although this is not always feasible with available equipment.

To best employ the mattress 120 as an overlay atop a standard hospital mattress (not shown), securing staps 400 and 401 are also provided to secure the mattress 120 in Place. Straps 400 and 401 are formed of elastic bands 402–404 and 405–406, respectively. Bands 402–404 and 405–406 are joined to mattress 120 by stitching 408–411 and 414–417, respectively, and to each other by stitching 412, 413, 418 and 419.

The foregoing descriptions are merely of exemplary embodiments of the invention. Many alternatives, objects, features, advantages and the like will be understood to those of ordinary skill in the art in view of these descriptions and the accompanying drawings and claims. Perhaps better put, the described embodiments include many features which could be eliminated, substituted by equivalents, varied, replaced, improved, combined or subdivided while still capturing the essence of the invention, which is best defined by the claims appended hereto.

We claim:

1. An inflatable patient support mattress comprising:

a plurality of inflatable cushions forming an elongate patient support mattress when inflated, said cushions including at least three cushions positioned along the length of said mattress to generally correspond to head, body and leg portions of a patient supported thereon;

a first of said three cushions being located near a first longitudinal end of said mattress and being inflatable separately from the others of said three cushions by means of a first air inlet located at said first longitudinal end of said mattress;

a second of said three cushions being located near the opposite longitudinal end of said mattress and being inflatable separately from the others of said three cushions by means of a second air inlet located at said first longitudinal end of said mattress, said second inlet being in fluid communication with said second cushion by means of a first elongate section positioned lengthwise along a first lateral edge of each of said three cushions of said mattress; and a third of said three cushions being located between said first cushion and said second cushion and being inflatable separately from the others of said three cushions by means of a third air inlet located at said first longitudinal end of said mattress, said third inlet being in fluid communication with said third cushion by means of a second elongate section positioned lengthwise along a second lateral edge of each of said three cushions of said mattress, the second lateral edge being opposite the first lateral edge.

2. The inflatable patient support mattress of claim 1 wherein each of said three cushions is formed of connected upper and lower sheets with retainers joining the upper and lower sheets in a manner which maintains a level patient support surface for each cushion.

3. The inflatable mattress of claim 2 wherein:

each of said first and second elongate sections has a higher profile than the level patient support surfaces of said three cushions to help prevent a patient from rolling or sliding off of said level patient support surfaces.

4. The inflatable mattress of claim 3 wherein:

each of said first and second elongate sections are joined with said cushions to form an integral mattress; and each of said first and second elongate sections extends along the entire length of said integral mattress.

5. The inflatable mattress of claim 4 wherein:

said first and second elongate sections comprise inflatable enclosures, an inflatable enclosure of said first elongate section being in fluid communication with said second cushion by means of an opening therebetween, an enclosure of said second elongate section being in fluid communication with said third suction by means of an opening therebetween.

6. The inflatable mattress as set forth in claim 2 wherein:

said retainers form dimples in he upper and lower sheets making up each cushion.

7. The inflatable mattress of claim 2 wherein:

said retainers comprise baffles within said three cushions, joining the upper and lower sheets thereof.

8. The inflatable mattress of claim 1 wherein:

at least a portion of an upper surfaces of each of said cushions is formed of a water vapor permeable but waterproof material.

9. The inflatable mattress of claim 8 wherein:

the upper surface of at least one of said cushions includes a second portion which is formed of an air permeable material.

10. The mattress as set forth in claim 1 wherein:

each of said three cushions is joined with said first and second elongate sections to form an integral mattress.

* * * * *